United States Patent [19]

Schmidt

[11] Patent Number: 4,838,111

[45] Date of Patent: Jun. 13, 1989

[54] LIMITING STOP FOR THE SWINGING ANGLE OF A PIVOTED ARM

[75] Inventor: Karl H. Schmidt, Wilnsdorf-Niederdielfen, Fed. Rep. of Germany

[73] Assignee: Siegenia-Frank KG, Siegen, Fed. Rep. of Germany

[21] Appl. No.: 176,856

[22] Filed: Apr. 4, 1988

[30] Foreign Application Priority Data

Apr. 4, 1987 [DE] Fed. Rep. of Germany ... 8705069[U]

[51] Int. Cl.[4] ..... G05G 1/04; E05D 15/30

[52] U.S. Cl. ..... 74/526; 43/248; 16/337; 403/53

[58] Field of Search ..... 49/339, 346, 248, 250; 403/53, 54; 74/526; 16/342, 337

[56] References Cited

U.S. PATENT DOCUMENTS

| | | | |
|---|---|---|---|
| 3,101,135 | 8/1963 | Neal et al. | 49/248 |
| 3,425,766 | 2/1969 | Crisera | 49/248 X |
| 3,939,529 | 2/1976 | Davis | 16/342 X |
| 4,414,706 | 11/1983 | Douglas | 49/248 X |
| 4,555,829 | 12/1985 | Davis | 49/250 X |
| 4,703,540 | 11/1987 | Davis | 16/337 |
| 4,726,092 | 2/1988 | Tacheny et al. | 16/342 X |

FOREIGN PATENT DOCUMENTS

| | | | |
|---|---|---|---|
| 2033018 | 1/1972 | Fed. Rep. of Germany | 49/248 |
| 2515988 | 10/1976 | Fed. Rep. of Germany | 49/250 |
| 2603056 | 8/1977 | Fed. Rep. of Germany | 49/248 |
| 93142 | 2/1969 | France | 49/248 |
| 2022669 | 12/1979 | United Kingdom | 49/248 |

*Primary Examiner*—Richard E. Moore
*Assistant Examiner*—Vinh Luong
*Attorney, Agent, or Firm*—Blodgett & Blogdett

[57] ABSTRACT

A limiting stop for the swinging angle of an arm which is pivotally mounted on a fixed structure. The stop consists of a pair of parallel links which are connected for relative sliding motion between at contracted position and an extended position. At least one of the links has an elongated slot and the other link has a laterally projecting tongue which extends into the slot for movement along the slot. One end of the slot has a stopping surface which is engaged by the tongue when the links are in the extended position for determining the swinging angle of the arm.

5 Claims, 1 Drawing Sheet

LIMITING STOP FOR THE SWINGING ANGLE OF A PIVOTED ARM

BACKGROUND OF THE INVENTION

The invention relates to a limiting stop for the swinging angle of an arm which is movable around a bearing axis wherein one end of a strut is pivoted to the structural part which carries the bearing axis and wherein the other end of the strut is pivoted to the arm at a distance from the bearing axis.

Such limiting stops are frequently required for example in the development field of building fittings. They are used for example to limit the opening angle of open-out arms for windows and doors relative to the stationary frame and/or to the closure member.

The installation space which is available for the accommodation of such limiting stops is frequently relatively small. It is, however, important that the limiting stops durably and reliably fulfill their intended function.

According to the invention, there is provided a limiting stop of this type which requires relatively little installation space and has high functional reliability and is of a structurally simple design. Such a limiting stop is distinguished in that the strut consists of two structurally similar links, each having a longitudinal slot and a stop tongue which extends laterally from the plane of the link. the stop tongue of each link is slidably engaged for lengthwise movement in the elongated slot of the other link. The elongated slot of each link has a stop end which lies adjacent to its top tongue. The end of each stop tongue has laterally projecting supporting flanges which can enter the slot through an enlarged end of the slot which is distant from the stop end of the slot, and can be brought into supporting engagement with the longitudinal edges of the slot. The relative displacement of the links is less than the distance between the stop end and the enlarged end of the elongated slot of each link.

In accordance with one embodiment of the invention, the outwardly facing end of one link is pivoted on the structural part which carries the bearing axis. The outwardly facing end of the other link is pivoted on the arm. In another embodiment of the invention, the links of the strut consist of strip material with flat-rectangular cross section.

It is obvious that the links for forming a limiting stop in accordance with the invention can be easily and simply fabricated as punched and bent parts and that two of these links can be assembled through simple plug coupling connections into a strut which serves as a limiting stop which is adjustable lengthwise within given limits.

BRIEF DESCRIPTION OF THE DRAWINGS

The subject matter of the invention is represented in the drawing in an exemplified embodiment in which:

In FIG. 1 of the drawing, the stationary frame 1 of a window, of a door or the like, is shown in diagrammatically simplified presentation, that is, by means of a dot-dash line a planar closure member 3 is suspended within the frame and is swingably movable relative to the frame.

DESCRIPTION OF THE PREFERRED EMBODIMENT

Figures 1, 2:
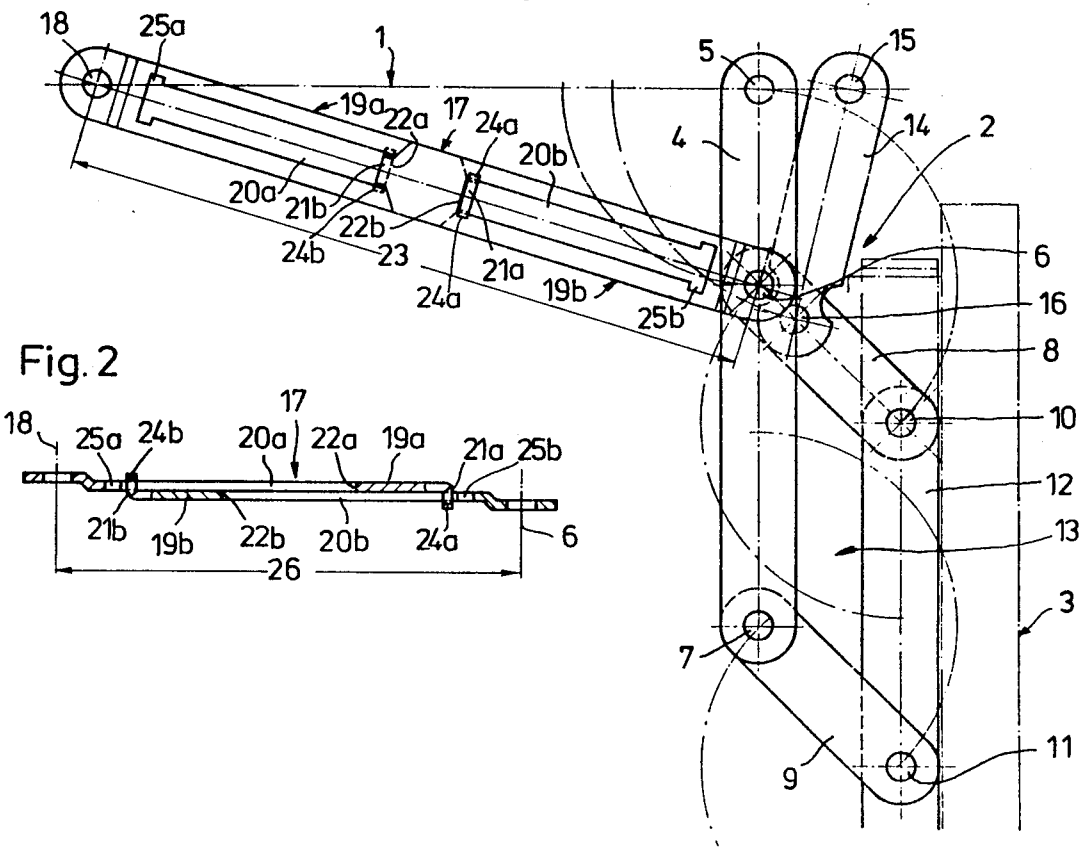
FIG. 1 a top view of a limiting stop in operative connection with a carrying and guiding system for the closure member of a window, of a door or the like, the limit stop being shown in the operative stoping position, and FIG. 2 a longitudinal cross section through the limiting stop mechanism of FIG. 1 but shown in the contracted or non-stoping position.

The carrying and guiding system which is generally indicated by the reference numeral 2 includes arm 4 which is suspended for swinging movement about a pivot pin axis 5 at a stationary frame 1. Two guide levers 8 and 9 are pivotally connected to the supporting arm 4 by means of two pivot pins 6 and 7 respectively. The levers 8 and 9 are of equal length. The guide levers 8 and 9 are, in turn, connected by pivot pins 10 or 11, respectively to a guide rail 12. The guide rail 12 is parallel with and secured to the closure member 3. The portion of the supporting arm 4 which lies between the pivot pins 6 and 7 forms, with the two guide levers 8 and 9 as well as with the guide rail 12, a guide parallelogram which is generally indicated by the reference numeral 13 Parallelogram 13 connects the closure member 3 with the stationary frame 1 The movement of the guide parallelogram 13 is affected through a control guide lever 14. One end of the control guide lever 14 is swingably suspended at the stationary frame at a bearing axis 5. The other end of the lever 14 is pivotally connected by a pivot pin 16 to the guide lever 8 at a point between the pivot pins 6 and 10. The control guide lever 14 affects the movement of the guide parallelogram 13 so that the closure member 3 is guided on its opening and closing motion along a path which is at least approximately limited by circular curves around a latent hinge axis which lies in the proximity of the side edge of the wing 3 adjacent to the bearing site.

In order to avoid injuries at the window or at the door as well as on the support and guide element system 2 it is necessary to limit the swinging angle for the supporting arm 4 around its bearing axis 5, for example to 90° to the plane of the stationary frame 1. A strut 17 functions as a limit stop for the swinging angle of the supporting arm 4. One end of the strut 17 is swingably suspended at a bearing axis 18 to the stationary frame 1. The other end of strut 17 engages the supporting arm 4, for example, through the hinge pin 6 at a point which is spaced from the bearing axis 5.

The strut 17 comprises two structurally similar overlapping links **19*a* and 19*b*. Each of the links 19*a* and 19*b* has an elongated slot and a stop tongue at one end of the link which extends at an angle to the plane of the link. The link 19*a* has a slot 20*a* and a stop tongue 21*a*. The link 19*b* has a slot 20*b* and a stop tongue 21*b*. The stop tongue of each link engages the elongated slot of the other link for lengthwise movement along the slot. The end of the elongated slot of each link which is nearest the stop tongue of the link acts as a stop end for the tongue of the other link. The slot 20*a* of link 19*a* has a stop end 22*a* and the slot 20*b* of the link 19*b* has a stop end 22*b*. In the fully extended position of the strut 17 as shown from FIG. 1, the distance between the pivot pins 6 and 18 is limited to the distance which is indicated by the reference numeral 23. When the strut 17 is in this extended position, the stop tongue 21*a* of the link 20*a* engages the stop end 22*b* in the elongated slot 20*b* of the link 19*b*, while the stop tongue 21*b* of the link 19*b* engages the stop end 22*a* in the elongated slot 20*a* of the link 19*a* as may clearly be seen in FIG. 1**.

In order that the links **19*a* and 19*b* which form the strut 17 can be assembled and held together in a simple manner, each stop tongue 21***a* and 21*b* has, at its free end, a laterally projecting retaining flange. The stop tongue 21*a* has retaining flanges 24*a* and the stop tongue 21*b* has retaining flanges 24*b*. The retaining flanges 24*a* and 24*b* of each tongue are brought into supporting and holding engagement with the longitudinal edges of the elongated slot of the other link through an enlarged end at the end of the elongated slot which is remote from the stop end of the slot. Slot 20*a* has an enlarged end 25*a* and slot 20*b* has an enlarged end 25*b*.

In the contracted position as shown in FIG. 2, the distance between the axis 16 and 18 is indicated by the reference numeral 26. The difference between the distance 23 and 26 represents the relative displacement of the links 19*a* and 19*b*. The relative displacement of the links 19*a* and 19*b* between the extended position shown in FIG. 1 and the contracted position of FIG. 2 is less than the distance between the stop end and the enlarged end of the slot. A undesired and automatic uncoupling of the lashings 19*a* and 19*b* forming the strut 17 is thereby avoided in a simple manner.

The two links 19*a* and 19*b* are identical and can therefore be fabricated with the same tool, as punched and bent parts out of strip material of flat-rectangular cross section. It is important that the stop tongues 21*a* and 21*b* of the two links 19*a* and 19*b* respectively engage for lengthwise movement within their assigned elongated slots 20*b* and 20*a* respectively while the free ends of the strut 17 are held on the pivot pins 6 and 18 for lengthwise movement.

The utilization of the strut 17 as a limiting stop for the swinging angle of an arm which is movable around a bearing axis is not necessarily limited to the support and guide system 2 as shown in FIG. 1. The limiting stop which is formed through the strut 17 can be used wherever the object is to limit the swinging angle for an arm which is movable around a bearing axis relative to the structural part which carries a bearing axis.

after assembly of the links 19*a* and 19*b* into the strut 17, it is also possible to press into the enlarged ends 25*a* and 25*b* of the elongated slots 20*a* and 20*b* filler pieces, e.g. of plastics, in a detent-like manner in order to prevent undesired decoupling of the links.

SUMMARY OF THE INVENTION

A limit stop for the swinging angle of an arm 4 which is movable around a pivot pin 5, such as is used for example as open-out arm between the closure member 3 and the stationary frame of a window or a door. The limit stop requires only a small installation space , has high functional reliability and is of a structurally simple construction. For this purpose, one end of a strut 17 is fastened through a pivot pin 18 on the structural part which also carries the pivot pin 5. The other end of the strut 17 is pivotally connected by a pivot pin 6 to the arm 4 at a distance from the pivot pin 5. The strut 17 consists of two structurally-similar links 19*a*, 19*b*. Each link has an elongated slot and a stop tongue which is spaced from the stop tongue of the other link and which is also bent off from the plane of the links. The stop tongue of each link 19*a*, 19*b* is, in each case, inserted for lengthwise movement in the elongated slot of the other link. The stop end 22*b* or 22*a* of the elongated slot of each link lies adjacent the stop tongue of the link. The end of each stop tongue has laterally projecting retaining flanges (24*a*,24*b*) which can be brought into supporting engagement with the longitudinal edges of the elongated slots of the links (25*a*,25*b*) which is spaced from the stop end of the elongated slot. The relative displacement of the links 19*a* and 19*b* can be limited to a length which is less than the distance between the stop end 22*a* or 22*b* and the enlarged end 25*a* or 25*b* of the elongated slots 20*a* or 20*b* of each link 19*a* or 19*b*.

I claim:

1. A limiting stop for the swinging angle of an arm which is movable around a bearing axis, on which one end of a strut is pivoted at the structural part which carries the bearing axis, the other end of the strut being pivotally connected to the arm at a distance from said bearing axis, said stop being characterized in that:

the strut consists of two structurally similar links , each of said links having an elongated slot and a stop tongue which extends at an angle to the plane of the link, that the stop tongue of each link extends into the elongated slot of the other link for lengthwise movement, that one end of the elongated slot of each link which lies adjacent to its stop tongue functions as a stop for the stop tongue of the other link, that each stop tongue displays at its end projecting supporting flanges which extend laterally of the longitudinal edges of the elongated slot of the opposite link except at an enlarged opening in the slot which is distant from the stop end of the slot and that the relative displacement of the links is less than the distance between the stop end and the enlarged end of each of said slots

2. A limiting stop as recited in claim 1, characterized in that:

the ends of both links facing away from one another are pivotally mounted, one of said ends being pivoted to the structural part which carries said bearing axis and the other of said ends being pivoted to said arm.

3. Limiting stop as recited in claim 1 characterized in that:

that the links of the strut are fabricated as punched and bent parts of strip material with flat-rectangular cross section.

4. A limiting stop for the swinging angle of an arm which is pivotally mounted on a fixed structure and which forms part of a closing linkage for a closure member for a door or window relative to a fixed casing, said limiting stops comprising:

(a) a first link which is pivoted at one end to a fixed structure (b) a second link which is parallel with the first link and is pivoted at one end to said arm at a point which is spaced from the pivot point of said arm, said second link being mounted on said first link for longitudinal sliding motion, (c) at least one of said first and second links having an elongated slot which has a stopping surface at one end of the slot, (d) at least the other of said first and second slots having a tongue which projects at an angle to the plane of the link and which extends into the slot of said one link for sliding movement along the slot between a contracted position in which the tongue is adjacent the other end of the slot and extended position in which the tongue engages said stopping surface, whereby the amount of swinging motion of said closure member is determined by the relative displacement of said first and second links in moving from said contracted position to said extended position.

5. A limiting stop as recited in claim 4, wherein each of said first and second links has an elongated slot and a tongue which extends into the slot of the other said links, and wherein each of said slots has a stopping surface at one end of the slot so that the stopping surface of each slot is engaged by the tongue of the other link when said links are in said extended position.

* * * * *